US008512035B2

(12) United States Patent
Super

(10) Patent No.: US 8,512,035 B2
(45) Date of Patent: Aug. 20, 2013

(54) MIXING DEVICE FOR A GAS BURNER

(75) Inventor: Willem Super, Emmen (NL)

(73) Assignee: Honeywell Technologies Sarl, Rolle (CH)

( * ) Notice: Subject to any disclaimer, the term of this patent is extended or adjusted under 35 U.S.C. 154(b) by 245 days.

(21) Appl. No.: 13/040,938

(22) Filed: Mar. 4, 2011

(65) Prior Publication Data

US 2011/0223551 A1 Sep. 15, 2011

(30) Foreign Application Priority Data

Mar. 9, 2010 (DE) ..... 10 2010 010 791

(51) Int. Cl.
*F23D 14/62* (2006.01)

(52) U.S. Cl.
USPC ..... 431/354; 431/177; 431/217

(58) Field of Classification Search
USPC ..... 431/177, 354, 217
See application file for complete search history.

(56) References Cited

U.S. PATENT DOCUMENTS

| | | | | |
|---|---|---|---|---|
| 1,878,926 | A | 9/1932 | Yarrow | |
| 2,021,241 | A | 11/1935 | Mall | |
| 2,771,308 | A | 11/1956 | Vitcha et al. | |
| 3,072,390 | A | 1/1963 | Phillips | |
| 3,081,818 | A | 3/1963 | Braconier et al. | |
| 3,455,260 | A | 7/1969 | Mennesson | |
| 3,514,041 | A * | 5/1970 | Van Rooyen | 239/427.3 |
| 3,538,940 | A | 11/1970 | Graham | |
| 3,574,359 | A | 4/1971 | Klein | |
| 3,593,967 | A | 7/1971 | Nutten | |
| 4,033,714 | A | 7/1977 | Longworth | |

(Continued)

FOREIGN PATENT DOCUMENTS

| | | |
|---|---|---|
| DE | 1972904 | 11/1967 |
| DE | 1601192 | 12/1970 |

(Continued)

OTHER PUBLICATIONS

BLP Products Inc., Installation Instructions: Carburetor Test Gauge Kit 7859, www.blp.com, Jul. 19, 2005, http://www.blp.com/pdf/install/7859_Carb_Test_Gauge.pdf.*

(Continued)

*Primary Examiner* — Kenneth Rinehart
*Assistant Examiner* — Gajanan Prabhu
(74) *Attorney, Agent, or Firm* — Seager Tufte & Wickhem LLC.

(57) ABSTRACT

A mixing device (10) for a gas burner, with a housing (11) having a combustion air inlet (13), a gas inlet (14) and an outlet (15) for the mixture of gas and combustion air, and with a Venturi device (12) which is positioned in the housing, wherein the Venturi device is contoured to form a contraction section (19), a mixing section (20) and a diffuser section (21). A guide device (22) for combustion air, which divides combustion air which enters the mixing device via the combustion air inlet (13) into a primary flow and a secondary flow, may be positioned inside the Venturi device, wherein the combustion air of the primary flow, issuing from the combustion air inlet, can be fed to the mixing section (20) via the contraction section (19), and wherein the combustion air of the secondary flow, issuing from the combustion air inlet, can be mixed downstream of the mixing section (20) in the region of the diffuser section (21) with the mixture of the gas and the combustion air of the primary flow.

20 Claims, 3 Drawing Sheets

(56) References Cited

U.S. PATENT DOCUMENTS

| | | | | |
|---|---|---|---|---|
| 4,116,476 | A | 9/1978 | Porter et al. | |
| 4,128,391 | A | 12/1978 | Braunstein | |
| 4,152,121 | A | 5/1979 | van der Weide et al. | |
| 4,202,760 | A | 5/1980 | Storey et al. | |
| 4,224,019 | A | 9/1980 | Dilmore | |
| 4,251,025 | A | 2/1981 | Bonne et al. | |
| 4,283,645 | A | 8/1981 | Hofmann | |
| 4,291,658 | A | 9/1981 | Masaki et al. | |
| 4,314,441 | A | 2/1982 | Yannone et al. | |
| 4,329,138 | A | 5/1982 | Riordan | |
| 4,334,855 | A | 6/1982 | Nelson | |
| 4,340,355 | A | 7/1982 | Nelson et al. | |
| 4,373,897 | A | 2/1983 | Torborg | |
| 4,381,187 | A * | 4/1983 | Sederquist | 48/212 |
| 4,439,139 | A | 3/1984 | Nelson et al. | |
| 4,458,719 | A | 7/1984 | Strybel | |
| 4,502,625 | A | 3/1985 | Mueller | |
| 4,533,315 | A | 8/1985 | Nelson | |
| 4,576,359 | A | 3/1986 | Oetiker | |
| 4,629,413 | A * | 12/1986 | Michelson et al. | 431/9 |
| 4,684,060 | A | 8/1987 | Adams et al. | |
| 4,688,547 | A | 8/1987 | Ballard et al. | |
| 4,703,795 | A | 11/1987 | Beckey | |
| 4,708,636 | A | 11/1987 | Johnson | |
| 4,729,207 | A | 3/1988 | Dempsey et al. | |
| 4,767,104 | A | 8/1988 | Plesinger | |
| 4,788,962 | A | 12/1988 | Mashburn et al. | |
| 4,797,072 | A | 1/1989 | Berfield et al. | |
| 4,819,587 | A | 4/1989 | Tsutsui et al. | |
| 4,830,600 | A | 5/1989 | VerShaw et al. | |
| 4,892,245 | A | 1/1990 | Dunaway et al. | |
| 4,894,067 | A | 1/1990 | Bayerstock | |
| 4,915,615 | A | 4/1990 | Kawamura et al. | |
| 5,026,270 | A | 6/1991 | Adams et al. | |
| 5,073,309 | A | 12/1991 | Bousquet et al. | |
| 5,150,880 | A | 9/1992 | Austin, Jr. et al. | |
| 5,152,276 | A | 10/1992 | Brock et al. | |
| 5,248,083 | A | 9/1993 | Adams et al. | |
| 5,307,990 | A | 5/1994 | Adams et al. | |
| 5,331,944 | A | 7/1994 | Kujawa et al. | |
| 5,340,028 | A | 8/1994 | Thompson | |
| 5,347,981 | A | 9/1994 | Southern et al. | |
| 5,370,527 | A | 12/1994 | Hefling et al. | |
| 5,408,986 | A | 4/1995 | Bigham | |
| 5,413,557 | A | 5/1995 | Solar | |
| 5,445,516 | A | 8/1995 | Stouffer | |
| 5,520,533 | A | 5/1996 | Vrolijk | |
| 5,529,000 | A | 6/1996 | Hartel et al. | |
| 5,590,642 | A | 1/1997 | Borgeson et al. | |
| 5,630,408 | A | 5/1997 | Versluis | |
| 5,720,231 | A | 2/1998 | Rowlette et al. | |
| 5,732,691 | A | 3/1998 | Maiello et al. | |
| 5,791,332 | A | 8/1998 | Thompson et al. | |
| 5,806,440 | A | 9/1998 | Rowlette et al. | |
| 5,819,721 | A | 10/1998 | Carr et al. | |
| 5,827,335 | A | 10/1998 | Ward | |
| 5,860,411 | A | 1/1999 | Thompson et al. | |
| 5,865,611 | A | 2/1999 | Maiello | |
| 5,971,026 | A | 10/1999 | Beran | |
| 5,993,195 | A | 11/1999 | Thompson | |
| 6,000,622 | A | 12/1999 | Tonner et al. | |
| 6,030,207 | A | 2/2000 | Saleri | |
| 6,109,255 | A | 8/2000 | Dieckmann et al. | |
| 6,234,456 | B1 | 5/2001 | Gerhardy | |
| 6,254,008 | B1 | 7/2001 | Erickson et al. | |
| 6,257,870 | B1 | 7/2001 | Hugghins et al. | |
| 6,283,115 | B1 | 9/2001 | Dempsey et al. | |
| 6,321,744 | B1 | 11/2001 | Dempsey et al. | |
| 6,354,327 | B1 | 3/2002 | Mayhew | |
| 6,377,426 | B2 | 4/2002 | Hugghins et al. | |
| 6,379,146 | B1 | 4/2002 | Zink et al. | |
| 6,474,959 | B2 | 11/2002 | Eisert | |
| 6,504,338 | B1 | 1/2003 | Eichorn | |
| 6,571,817 | B1 | 6/2003 | Bohan, Jr. | |
| 6,705,553 | B2 | 3/2004 | Drechsel | |
| 6,749,423 | B2 | 6/2004 | Fredricks et al. | |
| 6,758,909 | B2 | 7/2004 | Jonnalagadda et al. | |
| 6,764,298 | B2 | 7/2004 | Kim et al. | |
| 6,793,015 | B1 | 9/2004 | Brown et al. | |
| 6,846,514 | B2 | 1/2005 | Jonnalagadda et al. | |
| 6,866,202 | B2 | 3/2005 | Sigafus et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 6,925,999 | B2 | 8/2005 | Hugghins et al. | |
| 7,055,759 | B2 | 6/2006 | Wacker et al. | |
| 7,073,365 | B2 | 7/2006 | Geho et al. | |
| 7,090,203 | B2 * | 8/2006 | Goto | 261/22 |
| 7,101,172 | B2 | 9/2006 | Jaeschke | |
| 7,111,503 | B2 | 9/2006 | Brumboiu et al. | |
| 7,241,135 | B2 | 7/2007 | Munsterhuis et al. | |
| 7,293,718 | B2 | 11/2007 | Sigafus et al. | |
| 2001/0055709 | A1 | 12/2001 | Sang | |
| 2002/0155405 | A1 | 10/2002 | Casey et al. | |
| 2003/0104328 | A1 | 6/2003 | Kobayashi et al. | |
| 2005/0025638 | A1 | 2/2005 | Buffet | |
| 2005/0103019 | A1 | 5/2005 | Mansour et al. | |
| 2006/0092758 | A1 * | 5/2006 | Ellmers | 366/163.2 |
| 2007/0243496 | A1 | 10/2007 | Thiewes et al. | |
| 2008/0124668 | A1 | 5/2008 | Schultz et al. | |
| 2009/0138125 | A1 | 5/2009 | Sampson et al. | |
| 2010/0297568 | A1 | 11/2010 | Thiewes et al. | |
| 2011/0081619 | A1 | 4/2011 | Praat et al. | |

FOREIGN PATENT DOCUMENTS

| | | |
|---|---|---|
| DE | 3205935 | 9/1983 |
| DE | 3604314 | 8/1987 |
| DE | 19729047 | 9/1998 |
| DE | 19733768 | 2/1999 |
| DE | 19850958 | 5/2000 |
| DE | 20002136 | 7/2000 |
| DE | 1992226 | 11/2000 |
| DE | 102004007123 | 8/2005 |
| DE | 102005046560 | 4/2006 |
| DE | 102005020303 | 11/2006 |
| DE | 102006000174 | 10/2007 |
| EP | 0644377 | 3/1995 |
| EP | 0846916 | 6/1998 |
| EP | 0864814 | 9/1998 |
| EP | 0890787 | 1/1999 |
| EP | 1026445 | 8/2000 |
| EP | 1099906 | 5/2001 |
| EP | 1150070 | 10/2001 |
| EP | 1055085 | 1/2002 |
| EP | 1635116 | 3/2006 |
| EP | 1707878 | 10/2006 |
| EP | 1744102 | 1/2007 |
| EP | 2090827 | 8/2009 |
| FR | 2794521 | 12/2000 |
| GB | 1362781 | 8/1974 |
| GB | 1397536 | 6/1975 |
| GB | 2036295 | 6/1980 |
| JP | 52112830 | 9/1977 |
| JP | 52140928 | 11/1977 |
| JP | 55032923 | 3/1980 |
| JP | 56106045 | 8/1981 |
| JP | 61106957 | 5/1986 |
| JP | 10299662 | 1/1989 |
| JP | 1100357 | 4/1989 |
| JP | 1187325 | 7/1989 |
| JP | 2259269 | 10/1990 |
| JP | 5044599 | 2/1993 |
| JP | 10288483 | 10/1998 |
| JP | 2000274611 | 10/2000 |
| JP | 2007274611 | 10/2000 |
| NL | 1000129 | 9/1995 |
| WO | 9409326 | 4/1994 |
| WO | 02077526 | 10/2002 |
| WO | 2009133451 | 11/2009 |

OTHER PUBLICATIONS

Search Report for Corresponding European Application No. 11001358.8, dated Jun. 27, 2011.

Search Report for Corresponding German Application Serial No. 102010010791.3, 2 pages, Jun. 6, 2011.
Honeywell, VK41..R/VK81..R Series, Gas Controls With Integrated Gas/Air Module for Combined Valve and Ignition System, pp. 1-6, prior to Oct. 18, 2006.
Honeywell, 45.801.175-, Amplification Gas/Air Module for VK4105R/VK8105R Gas Controls, pp. 1-8, prior to Oct. 18, 2006.
http://www.regal-beloit.com/gedraft.html, Welcom to GE Commercial Motors by Regal-Beloit, 1 page, printed Apr. 26, 2006.
Lennox, "G61MPV Series Units," Installation Instructions, 2 pages, Oct. 2006.

* cited by examiner

MIXING DEVICE FOR A GAS BURNER

The present application claims priority to German Patent Application No. DE 10 2010 010 791.3, filed on Mar. 9, 2010, entitled "MIXING DEVICE FOR A GAS BURNER", which is incorporated herein by reference.

TECHNICAL FIELD

This disclosure relates to a mixing device for a gas burner.

BACKGROUND

A mixing device for a gas burner with a housing and a Venturi device which is positioned in the housing is known from DE 296 17 621 U1. The housing of the mixing device which is disclosed there has a combustion air inlet, a gas inlet and an outlet for the mixture of gas and combustion air. The Venturi device which is positioned in the housing is constructed as a Venturi nozzle and serves for the mixing of the combustion air and the gas.

A Venturi device, designed as a Venturi nozzle, for a mixing device of a gas burner, which is positioned in a housing of a mixing device and formed from an inlet funnel and a discharge funnel, is known from DE 197 43 464 C1, wherein the Venturi device, specifically the inlet funnel and the discharge funnel of the Venturi device, is contoured to form a contraction section, a mixing section and a diffuser section, and in such a way that the combustion air, issuing from the combustion air inlet, can be fed to the mixing section via the contraction section which narrows in the direction of the mixing section, and that the mixture of gas and combustion air, issuing from the mixing section, can be fed to the outlet via the widening diffuser section. In the mixing section, an inlet-side section of the discharge funnel overlaps a discharge-side section of the inlet funnel, forming an annular gap or an annular gap-like nozzle, via which the gas can be admixed with the combustion air.

For further clarification of the mixing devices of a gas burner, which are known from the prior art, reference may be made to FIG. 1 which shows a schematized cross section of a mixing device 10' which is known from the prior art. The mixing device 10' according to FIG. 1 comprises a housing 11', inside which a Venturi device 12' is positioned. The housing 11' of the mixing device 10' has a combustion air inlet 13' for combustion air V, a gas inlet 14' for gas G and also an outlet 15' for the mixture M of gas and combustion air. The Venturi device 12', which is positioned in the housing 11', also has the combustion air inlet 13' and also the outlet 15' for the mixture M of gas and combustion air, wherein the gas G, which enters the housing 11' via the gas inlet 14', flows radially outward around the Venturi device 12' and, via an annular gap 16' which is formed between an inlet funnel 17' and a discharge funnel 18' of the Venturi device 12', can be admixed with or added to the combustion air V. The Venturi device 12', which includes the inlet funnel 17' and the discharge funnel 18', forming a contraction section 19', a mixing section 20' and a diffuser section 21', is contoured in such a way that the combustion air V, issuing from the combustion air inlet 13' of the housing 10' or of the Venturi device 12', can be fed to the mixing section 20' via the contraction section 19' which narrows in the direction of the mixing section 20'. The mixture M of gas and combustion air, issuing from the mixing section 20', can be fed to the outlet 15' via the diffuser section 21', which widens in the direction of the outlet 15'. The annular gap 16' is located in the mixing section 20'. The annular gap 16' has a cross section which results from a diameter difference between the outside diameter of a discharge-side end of the inlet funnel 17' and the inside diameter of an inlet-side end of the discharge funnel 18' in the mixing section 20'. The outside diameter of the annular gap 16' thus corresponds to the inside diameter of the inlet-side end of the discharge funnel 18' and therefore to the diameter of the mixing section 20'.

A fan or a blower is typically associated with the outlet 15' or with the combustion air inlet 13' of such a mixing device of a gas burner, wherein a speed of the fan or of the blower determines the quantity or the volumetric flow of the mixture of gas and combustion air which is fed to the gas burner. The ratio of gas and combustion air in the combustion air/gas mixture is meant to be relatively constant and is primarily determined by a ratio of the cross section of the inlet funnel 17' in the mixing section 20' of the Venturi device 12' and the cross section of the annular gap 17' which is formed between the inlet funnel 17' and the discharge funnel 18' of the Venturi device 12'. Regardless of the speed of the fan, the ratio of gas and combustion air in the combustion air/gas mixture is supposed to be constant, wherein with increasingly or reducing speed of the fan, undesirable deviations in the ratio of gas and combustion air develop on account of inaccuracies with respect to control engineering. In the case of known mixing devices, the speed of a fan which interacts with the mixing device can be reduced only to a certain extent while maintaining the desired ratio of gas and combustion air. This ultimately results in a realizable modulation range of between 1 and 5, in which a high modulation quality, specifically a desired ratio of gas and combustion air in the combustion air/gas mixture, can be provided. A modulation of 1 corresponds to a full load speed of the fan and a modulation of 5 corresponds to 20% of the full load speed of the fan. With mixing devices which are known from the prior art, the speed of the fan which interacts with the mixing device can therefore be reduced only to 20% of the full load speed of the fan while maintaining the desired ratio of gas and combustion air.

SUMMARY

This disclosure relates to a new type of mixing device for a gas burner, which on the one hand has a low flow resistance and on the other hand enables a broader modulation range while helping to ensure a high modulation quality.

In one illustrative embodiment, a guide device for combustion air, which divides combustion air which enters the mixing device via the combustion air inlet into a primary flow and a secondary flow, is positioned inside the Venturi device, wherein the combustion air of the primary flow, issuing from the combustion air inlet, can be fed to the mixing section via the contraction section, and wherein the combustion air of the secondary flow, issuing from the combustion air inlet, can be mixed downstream of the mixing section in the region of the diffuser section with the mixture of the gas and the combustion air of the primary flow.

In some instances, it may be ultimately possible to have a broader modulation range between 1 and 10 with good modulation quality for a fan which interacts with the mixing device. Using the mixing device according to this disclosure, the speed of a fan which interacts with the mixing device may be reduced to 10% (or less) of the full load speed of the fan while maintaining the desired ratio of gas and combustion air. In some instances, the speed of a fan which interacts with the device may be reduced to a greater extent than in the case of mixing devices which are known from the prior art, and this while maintaining a desired ratio of gas and combustion air. Furthermore, a low flow resistance may be accomplished.

The above summary is not intended to describe each disclosed embodiment or every implementation. The Figures, Description and Examples which follow more particularly exemplify these embodiments.

BRIEF DESCRIPTION

The disclosure may be more completely understood in consideration of the following description of various embodiments in connection with the accompanying drawings, in which.

DESCRIPTION

Figure 1:
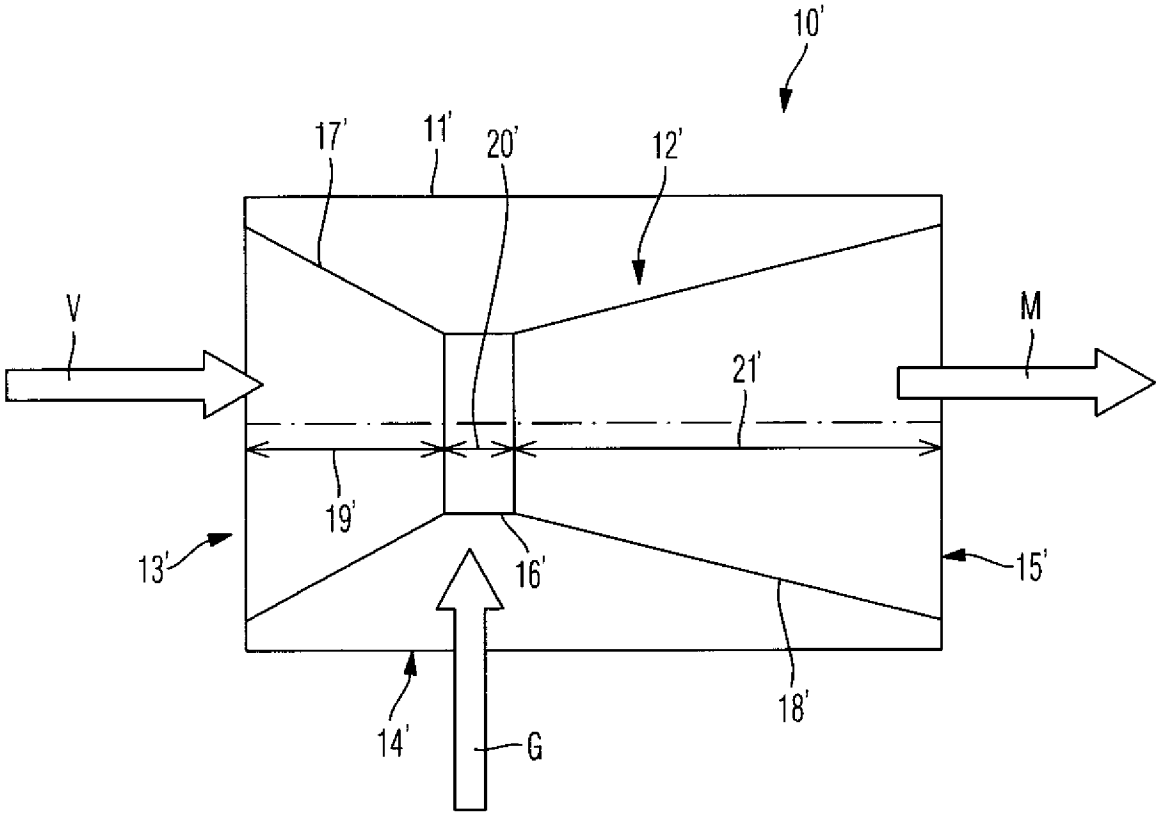
Fig. 1 Prior Art
FIG. 1 shows a schematized cross section through a mixing device which is known from the prior art for mixing gas and combustion air for a gas burner.
Figure 2:
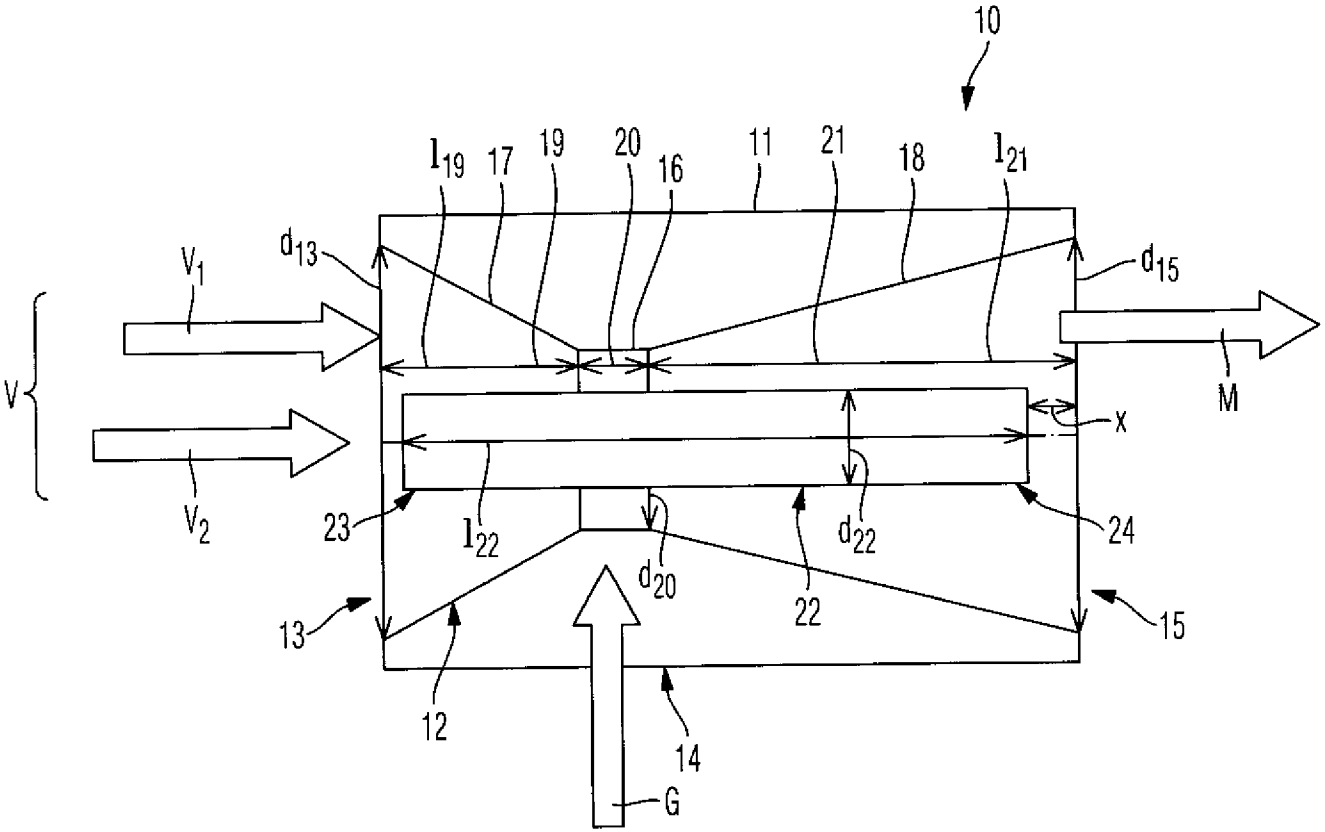
FIG. 2 shows a schematized cross section through a mixing device for mixing gas and combustion air for a gas burner according to an exemplary embodiment.

FIG. 2 shows a schematized cross section of a first exemplary embodiment of a mixing device 10, wherein the mixing device 10 includes a housing 11, inside which a Venturi device 12 is positioned. The housing 11 of the mixing device 10 has a combustion air inlet 13 for combustion air V, a gas inlet 14 for gas G, and also an outlet 15 for the mixture M of gas and combustion air.

The Venturi device 12, which is positioned in the housing 11, also has the combustion air inlet 13 and also the outlet 15 for the mixture of gas and combustion air, wherein the gas G, which enters the housing 11 via the gas inlet 14, flows radially outwards around the Venturi device 12, which is visible in FIG. 2, and, via an annular gap 16 which is formed between an inlet funnel 17 and a discharge funnel 18 of the Venturi device 12, can be admixed with or added to the combustion air V.

The Venturi device 12, which includes the inlet funnel 17 and the discharge funnel 18, is contoured to form a contraction section 19, a mixing section 20 and a diffuser section 21.

In some instances, a guide device 22 for the combustion air is positioned inside the Venturi device 12. The guide device 22 divides the combustion air V, which enters the mixing device 10 or the Venturi device 12 via the combustion air inlet 13, into a primary flow $V_1$ and a secondary flow $V_2$. The combustion air of the primary flow $V_1$, which flows around the guide device 22, issuing from the combustion air inlet 13, can be fed to the mixing section 20 via the contraction section 19, wherein the combustion air of the primary flow $V_1$ is mixed in the region of the mixing section 20 with the gas G which enters the mixing device 10 via the gas inlet 14. The combustion air of the secondary flow $V_2$, which flows through the guide device 22, issuing from the combustion air inlet 13, can be mixed downstream of the mixing section 20 in the region of the diffuser section 21 with the mixture of the combustion air of the primary flow $V_1$ and the gas.

By establishing the secondary flow $V_2$ of the combustion air, which flows through the guide device 22 and is mixed with the gas and the combustion air of the primary flow $V_1$ downstream of the mixing section 20, a broader modulation range can be realized, and this while maintaining a high modulation quality.

In the exemplary embodiment of the mixing device 10 which is shown in FIG. 2, the guide device 22 is positioned centrally in the Venturi device 12, and in some cases concentrically. Also, the guide device 22 has a tubular contour, specifically a continuously cylindrical contour, in the exemplary embodiment which is shown in FIG. 2, and has a defined diameter $d_{22}$ and a defined length $l_{22}$. In the depicted exemplary embodiment of FIG. 2, the diameter $d_{22}$ of the tubular guide device 22 is constant over the entire length $l_{22}$ of the device.

The inlet 13 for the combustion air V has a diameter $d_{13}$ and the outlet 15 for the mixture M of gas and combustion air has a diameter $d_{15}$. The mixing section 20 has a diameter $d_{20}$.

The ratio $d_{13}/d_{15}$ between the diameter $d_{13}$ of the inlet 13 for the combustion air V and the diameter $d_{15}$ of the outlet 15 for the mixture M of gas and combustion air may be, for example, between 0.75 and 1.25, especially (100±25) %. This ratio $d_{13}/d_{15}$ is preferably 1.0.

The ratio $d_{20}/d_{15}$ between the diameter $d_{20}$ of the mixing section 20 and the diameter $d_{15}$ of the outlet 15 for the mixture M of gas and combustion air may be, for example, between 0.25 and 0.75, especially (50±25) %. This ratio $d_{20}/d_{15}$ is preferably 0.5.

The ratio $l_{19}/d_{20}$ between the length $l_{19}$ of the contraction section 19 and the diameter $d_{20}$ of the mixing section 20 may be, for example, between 0.5 and 1.5, especially 1±0.5. This ratio $l_{19}/d_{20}$ is preferably 1.

The ratio $l_{21}/d_{20}$ between the length $l_{21}$ of the diffuser section 21 and the diameter $d_{20}$ of the mixing section 20 may be, for example, between 2 and 6, especially 4±2. This ratio $l_{21}/d_{20}$ is preferably 4.

As already mentioned, the guide device 22, which may be positioned in the Venturi device 12, has the diameter $d_{22}$. The ratio $d_{22}/d_{20}$ between the diameter $d_{22}$ of the guide device 22 and the diameter $d_{20}$ of the mixing section 20 may be, for example, between 0.05 and 0.55, especially (30±25) %. This ratio $d_{22}/d_{20}$ is preferably 0.3.

The ratio $l_{22}/d_{22}$ between the length $l_{22}$ of the guide device 22 and the diameter $d_{22}$ of the guide device may be, for example, between 5 and 15, especially 10±5. This ratio $l_{22}/d_{22}$ is preferably 10.

The distance x between the flow discharge-side end 24 of the guide device 22 and the outlet 15 for the mixture M of gas and combustion air is dimensioned in such a way that the ratio $x/d_{20}$ between this distance x and the diameter $d_{20}$ of the mixing section 20 may be between 0 and 2, especially 1±1. The ratio $x/d_{20}$ is preferably 1.

In the depicted exemplary embodiment of FIG. 2, the flow discharge-side end 24 of the guide device 22 may lie upstream of the outlet 15 for the mixture of gas and combustion air.

The flow discharge-side end 24 of the guide device 22, which in the depicted exemplary embodiment of FIG. 2 preferably has a cylindrical contour, can be flared like a funnel.

The flow inlet-side end 23 of the guide device 22 in the depicted exemplary embodiment of FIG. 2 may lie downstream of the combustion air inlet 13. The offset between the flow inlet-side end 23 of the guide device 22 and the combustion air inlet 13 preferably corresponds at most to the diameter $d_{22}$ of the guide device 22.

In contrast to this, it is also possible, however, that the flow inlet-side end 23 of the guide device 22 terminates flush with the combustion air inlet 13, or may even extend out past the air inlet 13.

In the exemplary embodiment of FIG. 2, the tubular guide device 22 is shown to be cylindrically contoured, and therefore has a diameter $d_{22}$ which is constant over the entire length $l_{22}$ of the guide device 22.

In the exemplary embodiment of FIG. 2, the guide device 22 has a circular contour in cross section. In contrast to this, the guide device 22 may have an oval or elliptical contour in cross section, wherein the diameter $d_{22}$ is then the so-called large axis of the respective ellipse. These are only examples, and it is contemplated that the guide device 22 may have any suitably shaped contour, as desired.

Figure 3:
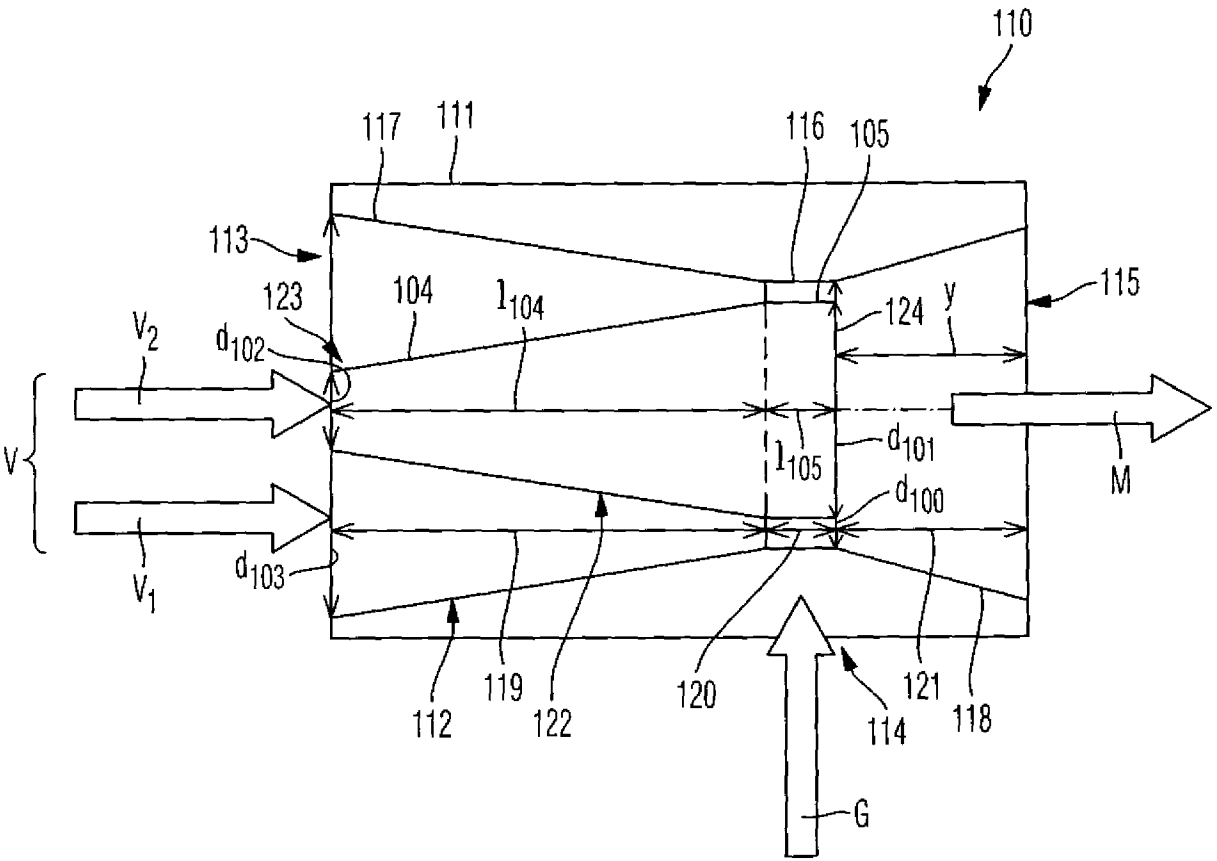
FIG. 3 shows a schematized cross section through a mixing device for mixing gas and combustion air for a gas burner according to another exemplary embodiment.

FIG. 3 shows another exemplary embodiment of a mixing device 110, wherein the mixing device 110 includes a housing 111, inside which a Venturi device 112 is positioned. The housing 111 of the mixing device 110 has a combustion air inlet 113 for combustion air V, a gas inlet 114 for gas G and also an outlet 115 for the mixture M of gas and combustion air. The Venturi device 112, which is positioned in the housing 111, also has the combustion air inlet 113 and also the outlet 115 for the mixture of gas and combustion air, wherein the gas G, which enters the housing 111 via the gas inlet 114, flows radially outward around the Venturi device 112 which is visible in FIG. 3, and, via an annular gap 116 which is formed between an inlet funnel 117 and a discharge funnel 118 of the Venturi device 112, can be admixed with or added to the combustion air V. In the illustrative embodiment, the Venturi device 112, which may include the inlet funnel 117 and the discharge funnel 118, is contoured to form a contraction section 119, a mixing section 120 and a diffuser section 121.

As show in FIG. 3, a guide device 122 for the combustion air may be positioned inside the Venturi device 112. The guide device 122 may divide the combustion air V, which enters the mixing device 110 or the Venturi device 112 via the combustion air inlet 113, into a primary flow $V_1$ and a secondary flow $V_2$. The combustion air of the primary flow $V_1$, which flows around the guide device 122, issuing from the combustion air inlet 113, can be fed to the mixing section 120 via the contraction section 119, wherein the combustion air of the primary flow $V_1$ is mixed in the region of the mixing section 120 with the gas G which enters the mixing device 110 via the gas inlet 114.

The combustion air of the secondary flow $V_2$, which flows through the guide device 122, issuing from the combustion air inlet 113, can be mixed downstream of the mixing section 120 in the region of the diffuser section 121 with the mixture of the combustion air of the primary flow $V_1$ and the gas. By establishing the secondary flow $V_2$ of combustion air which flows through the guide device 122 and is mixed downstream of the mixing section 120 with the gas and the combustion air of the primary flow $V_1$, a broad modulation range can be realized, and this while maintaining a high modulation quality.

In the exemplary embodiment of the mixing device 110 which is shown in FIG. 3, the guide device 122 may have a tubular contour and has two sections, specifically a truncated cone-like section 104, which widens out in the flow direction, and a cylindrical section 105, which adjoins the truncated cone-like section 104 downstream. The truncated cone-like section 104 has a length $l_{104}$, a flow inlet-side or upstream diameter $d_{102}$ and a flow discharge-side or downstream diameter $d_{101}$. The cylindrical section 105 has a length $l_{105}$ and a diameter which corresponds to the flow discharge-side or downstream diameter $d_{101}$ of the truncated cone-like section 104. The inlet 113 for the combustion air V has a diameter $d_{103}$ and the mixing section 120 has a diameter $d_{100}$.

A ratio $l_{104}/d_{102}$ between the length $l_{104}$ of the truncated cone-like section 104 of the guide device 122 and the flow inlet-side or upstream diameter $d_{102}$ of the truncated cone-like section 104 of the guide device 122 may be, for example, between 2 and 6, especially 4±2. The ratio $l_{104}/d_{102}$ is preferably 4.

A ratio $l_{105}/d_{102}$ between the length $l_{105}$ of the cylindrical section 105 of the guide device 122 and the flow inlet-side or upstream diameter $d_{102}$ of the truncated cone-like section 104 of the guide device 122 may be, for example, between 1 and 3, especially 2±1. The ratio $l_{105}/d_{102}$ is preferably 2.

A ratio $d_{102}/d_{101}$ between the flow inlet-side or upstream diameter $d_{102}$ of the truncated cone-like section 104 of the guide device 122 and the flow discharge-side or downstream diameter $d_{101}$ of the truncated cone-like section 104 of the guide device 122 may be, for example, between 0.25 and 0.75, especially (50±25) %. This ratio $d_{102}/d_{101}$ is preferably 0.5.

A ratio $d_{101}/d_{100}$ between the flow discharge-side or downstream diameter $d_{101}$ of the section 104 of the guide device 122, which corresponds to the diameter of the section 105, and the diameter $d_{100}$ of the mixing section 120 may be, for example, between 0.81 and 0.99, especially (90±9) %. This ratio $d_{101}/d_{100}$ is preferably 0.9.

A ratio $d_{103}/d_{100}$ between the diameter $d_{103}$ of the inlet 113 for the combustion air V and the diameter $d_{100}$ of the mixing section 120 may be, for example, between 0.9 and 1.3, especially (110±20) %. This ratio $d_{103}/d_{100}$ is preferably 1.1.

A ratio $y/d_{100}$ of the distance y between a flow discharge-side end 124 of the guide device 122 and the outlet 115 for the mixture of gas and combustion air and the diameter $d_{100}$ of the mixing section 120 may be, for example, between 0.5 and 2.5.

In the exemplary embodiment of FIG. 3, the flow discharge-side end 124 of the guide device 122 lies upstream of the outlet 115 for the mixture M, specifically exactly at the end of the mixing section 120 according to FIG. 3, however, this is not required.

The flow discharge-side end 124 of the guide device 122 may terminate flush with the end of the mixing section 120 according to FIG. 3. The flow discharge-side end 124 of the guide device 122 can also lie downstream (or even upstream in some cases) of the end of the mixing section 120.

In each case, the combustion air of the secondary flow $V_2$, issuing from the combustion air inlet 113, may be mixed downstream of the mixing section 120 in the region of the diffuser section 121 with the mixture of the gas G and the combustion air of the primary flow $V_1$.

The flow inlet-side end 123 of the guide device 122 may lie exactly at the inlet 113 of the combustion air and terminate flush with the combustion air inlet 113, as shown in exemplary embodiment of FIG. 3, but this is not required. It is also possible that the flow inlet-side end 123 of the guide device 122 lies downstream (or even upstream) of the combustion air inlet 113.

The flow discharge-side end of the section 104 of the guide device 122, and therefore the flow inlet-side end of the section 105 of the guide device 122, may terminate flush with the start of the mixing section 120 according to FIG. 3, but again, this is not required. For example, the flow discharge-side end of the section 104 of the guide device 122, and therefore the flow inlet-side end of the section 105 of the guide device 122, can lie downstream or upstream of the start of the mixing section 120.

In the exemplary embodiment of FIG. 3, the guide device 122 has a circular contour in cross section. In contrast to this, it is also possible that the guide device 122 has an oval, elliptical, or any other suitable shape contour in cross section.

In the exemplary embodiment of FIG. 2, the guide device 22 provides a type of bypass to the contraction section 19 in which the secondary flow $V_2$ is neither contracted nor expanded. In the exemplary embodiment of FIG. 3, on the other hand, the secondary flow $V_2$ is expanded in the section 104 of the guide device 122, whereas in parallel to this the primary flow $V_1$ is contracted in the contraction section 119. With both exemplary embodiments, a broader modulation range can be realized, and this while maintaining a high modulation quality. At the same time, a low flow resistance or throughflow resistance may be achieved.

LIST OF DESIGNATIONS

10, 110, 10' Mixing device
11, 111, 11' Housing
12, 112, 12' Venturi device
13, 113, 13' Combustion air inlet
14, 114, 14' Gas inlet
15, 115, 15' Outlet
16, 116, 16' Annular gap
17, 117, 17' Inlet funnel
18, 118, 18' Discharge funnel
19, 119, 19' Contraction section
20, 120, 20' Mixing section
21, 121, 21' Diffuser section
22, 122 Guide device
23, 123 Flow inlet-side end
24, 124 Flow discharge-side end
104 Section
105 Section
V Combustion air
$V_1$ Primary flow
$V_2$ Secondary flow
G Gas
M Mixture of gas and combustion air

What is claimed is:

1. A mixing device for mixing gas and combustion air for a gas burner, the mixing device having a housing that defines a combustion air inlet, a gas inlet, and an outlet, the mixing device comprising:

a venturi which serves to mix the combustion air and the gas, wherein the venturi includes a contraction section, a mixing section and a diffuser section; and a guide device positioned inside the venture, the guide device divides combustion air which enters the mixing device via the combustion air inlet of the housing into a primary flow and a secondary flow, wherein the combustion air of the primary flow, issuing from the combustion air inlet of the housing, is fed to the mixing section via the contraction section and is mixed with the gas to form a first mixture, and wherein the combustion air of the secondary flow, issuing from the combustion air inlet of the housing, is mixed downstream of the mixing section in the region of the diffuser section with the mixture of the gas and the combustion air of the primary flow to form a second mixture.

2. The mixing device of claim 1, wherein the guide device is positioned concentrically in the venturi.

3. The mixing device of claim 1, wherein the guide device has a cylindrical shape.

4. The mixing device of claim 3, wherein a ratio between a diameter of the guide device and a diameter of the mixing section of the venturi is between 0.05 and 0.55.

5. The mixing device of claim 3, wherein a ratio between a length of the guide device and a diameter of the guide device is between 5 and 15.

6. The mixing device of claim 3, wherein a ratio between a length of the contraction section of the venturi and a diameter of the mixing section of the venturi is between 0.5 and 1.5.

7. The mixing device of claim 3, wherein a ratio between a length of the diffuser section of the venturi and a diameter of the mixing section of the venturi is between 2 and 6.

8. The mixing device of claim 3, wherein a ratio of a distance (x) between a flow discharge-side end of the guide device and the outlet of the housing, and a diameter of the mixing section of the venturi is between 0 and 2.

9. The mixing device of claim 3, wherein:

a ratio between a diameter of the guide device and a diameter of the mixing section of the venturi is between 0.05 and 0.55;

a ratio between a length of the guide device and the diameter of the guide device is between 5 and 15;

a ratio between a length of the contraction section of the venturi and the diameter of the mixing section of the venturi is between 0.5 and 1.5;

a ratio between a length of the diffuser section of the venturi and the diameter of the mixing section of the venturi is between 2 and 6.

10. The mixing device of claim 9, wherein a ratio of a distance (x) between a flow discharge-side end of the guide device and the outlet of the housing, and the diameter of the mixing section of the venturi is between 0 and 2.

11. The mixing device of claim 1, wherein the guide device is of a tubular design, and includes a truncated cone-shaped section which widens out in the flow direction and a cylindrical section which adjoins the truncated cone-shaped section downstream.

12. The mixing device of claim 11, wherein a ratio between a length of the truncated cone-shaped section of the guide device and an upstream diameter at an upstream end of the truncated cone-shaped section of the guide device is between 2 and 6.

13. The mixing device of claim 11, wherein a ratio between a length of the cylindrical section of the guide device and an upstream diameter at an upstream end of the truncated cone-shaped section of the guide device is between 1 and 3.

14. The mixing device of claim 11, wherein a ratio between an upstream diameter at an upstream end of the truncated cone-shaped section of the guide device and a downstream diameter at a downstream end of the truncated cone-shaped section of the guide device is between 0.25 and 0.75.

15. The mixing device of claim 11, wherein a ratio between a downstream diameter at a downstream end of the truncated cone-shaped section of the guide device and a diameter of the mixing section of the venturi is between 0.81 and 0.99.

16. The mixing device of claim 11, wherein a ratio of a distance (y) between a flow discharge-side end of the guide device and the outlet of the housing, and a diameter of the mixing section of the venturi is between 0.5 and 2.5.

17. The mixing device of claim 11, wherein:

a ratio between a length of the truncated cone-shaped section of the guide device and an upstream diameter at the upstream end of the truncated cone-shaped section of the guide device is between 2 and 6;

a ratio between a length of the cylindrical section of the guide device and the upstream diameter at the upstream end of the truncated cone-shaped section of the guide device is between 1 and 3;

a ratio between the upstream diameter at the upstream end of the truncated cone-shaped section of the guide device and a downstream diameter at a downstream end of the truncated cone-shaped section of the guide device is between 0.25 and 0.75; and a ratio between the downstream diameter at the downstream end of the truncated cone-shaped section of the guide device and a diameter of the mixing section of the venturi is between 0.81 and 0.99.

18. The mixing device of claim 17, wherein a ratio of a distance (y) between a flow discharge-side end of the guide device and the outlet of the housing, and the diameter of the mixing section of the venturi is between 0.5 and 2.5.

19. A mixing device for mixing gas and combustion air for a gas burner, the mixing device having a housing that defines a combustion air inlet, a gas inlet, and an outlet, the mixing device comprising:

a venturi that includes a contraction section, followed by a mixing section, followed by a diffuser section;

the gas inlet of the mixing device is in fluid communication with the mixing section of the venturi to provide gas to the mixing section of the venturi;

a guide device having an outer wall that defines a lumen that extends through the guide device from an upstream end of the guide device to a downstream end of the guide device, wherein the guide device is positioned in the venturi and passes through at least part of the mixing section of the venture such that an outlet of the guide device is downstream of an inlet of the mixing section; and the guide device dividing combustion air that enters the combustion air inlet of the mixing device into a primary flow, which flows between the outer wall of the guide device and an inner wall of the venturi, and a secondary flow, which flows through the lumen of the guide device.

20. A mixing device for mixing gas and combustion air for a gas burner, the mixing device having a housing that defines a combustion air inlet, a gas inlet, and an outlet, the mixing device comprising:

a venturi that includes a contraction section, followed by a mixing section, followed by a diffuser section;

the gas inlet of the mixing device is in fluid communication with the mixing section of the venturi to provide gas to the mixing section of the venturi;

a guide device having an outer wall that defines a lumen that extends through the guide device from an upstream end of the guide device to a downstream end of the guide device, wherein the upstream end of the guide device is positioned upstream of the mixing section of the venturi and the downstream end of the guide device is downstream of the mixing section of the venturi; and the guide device dividing combustion air that enters the combustion air inlet of the mixing device into a primary flow, which flows between the outer wall of the guide device and an inner wall of the venturi, and a secondary flow, which flows through the lumen of the guide device.

* * * * *